US008517441B2

(12) United States Patent
Karlson

(10) Patent No.: US 8,517,441 B2
(45) Date of Patent: Aug. 27, 2013

(54) RAILWAY CAR INDEPENDENT AXLES WITH AXLE LOCKING MECHANISM

(76) Inventor: Larry Markus Karlson, Prince George (CA)

( * ) Notice: Subject to any disclaimer, the term of this patent is extended or adjusted under 35 U.S.C. 154(b) by 338 days.

(21) Appl. No.: 12/801,708

(22) Filed: Jun. 22, 2010

(65) Prior Publication Data

US 2010/0320790 A1 Dec. 23, 2010

Related U.S. Application Data

(63) Continuation-in-part of application No. 12/457,724, filed on Jun. 19, 2009, now abandoned.

(51) Int. Cl.
*B60B 35/00* (2006.01)

(52) U.S. Cl.
USPC ..... 295/37; 295/39

(58) Field of Classification Search
USPC ..... 295/36.1, 37–40, 48, 50; 301/126, 301/131–132; 403/43; 180/53.62, 247, 250
See application file for complete search history.

(56) References Cited

U.S. PATENT DOCUMENTS

| | | | | |
|---|---|---|---|---|
| 12,572 A | | 3/1855 | Prentiss | |
| 35,083 A | * | 4/1862 | Cooper | 295/39 |
| 89,767 A | | 5/1869 | Hunt | |
| 127,637 A | | 6/1872 | Nutting | |
| 134,247 A | | 12/1872 | Braymer et al. | |
| 161,989 A | | 4/1875 | Swarthout | |
| 200,798 A | | 2/1878 | Millington | |
| 205,324 A | | 6/1878 | Whittic | |
| 223,095 A | | 12/1879 | Barnes | |
| 269,926 A | * | 1/1883 | Farnum | 295/38 |
| 302,120 A | | 7/1884 | Fleming | |
| 320,601 A | | 6/1885 | Thornhill et al. | |
| 359,827 A | * | 3/1887 | White | 295/39 |
| 407,256 A | | 7/1889 | Seymour | |

(Continued)

OTHER PUBLICATIONS

John A. Elkins, Independent Rotating Wheels: A Simple Modification to Improve the Performance of the Conventional Three-Piece Truck, 9th International Wheelset Congress, Sep. 1988, 9 pages; Montreal, Canada.

*Primary Examiner* — Jason Bellinger
(74) *Attorney, Agent, or Firm* — Antony C. Edwards

(57) ABSTRACT

A railway car axle includes a first stub axle mounted in a rigid hollow sleeve. The first stub axle has opposite inner and outer ends, and the sleeve has a first open end and an oppositely disposed first terminal end. A first bore is defined by a cylindrical wall extending from the first open end to the first terminal end. The first stub axle is journalled in the first bore so as to position the inner end of the first stub axle adjacent the first terminal end and so that the outer end of the first stub axle extends from the first open end. Separate first inner and first outer bearing housings, and corresponding first bearings, are mounted tight to the inner ends of the first stub axle or to outer housing and the first open end of the sleeve respectively so as to allow rotation of the first stub axle relative to the sleeve. A mirror image may be provided for mounting a second stub axle in the sleeve. The stiffness for resisting bending of the axle due to downward loading of the axle laterally outwardly of wheels mounted on the ends of the axle is provided by the wall thickness of the sleeve. A locking mechanism may be provided to lock the sleeve onto one stub axle so that the stub axle is not free to rotate independently of the sleeve.

9 Claims, 18 Drawing Sheets

(56) References Cited

U.S. PATENT DOCUMENTS

| | | | | | |
|---|---|---|---|---|---|
| 420,624 | A | | 2/1890 | Hoyt | |
| 441,014 | A | | 11/1890 | Mahood | |
| 445,199 | A | * | 1/1891 | Pomeroy | 295/39 |
| 548,567 | A | | 10/1895 | Mahood | |
| 551,746 | A | | 12/1895 | Denney | |
| 662,540 | A | | 11/1900 | Massey | |
| 780,211 | A | | 1/1905 | Massey | |
| 808,301 | A | * | 12/1905 | McCormick | 295/39 |
| 934,003 | A | | 9/1909 | Markarian | |
| 944,463 | A | * | 12/1909 | Rendall | 295/38 |
| 977,002 | A | | 11/1910 | Girt et al. | |
| 1,109,464 | A | * | 9/1914 | Randall | 295/39 |
| 1,171,897 | A | * | 2/1916 | Slick | 295/38 |
| 1,206,583 | A | * | 11/1916 | Palley | 295/37 |
| 1,564,628 | A | * | 12/1925 | Rowe | 295/9.1 |
| 2,073,829 | A | | 3/1937 | Brown | |
| 2,440,351 | A | * | 4/1948 | Showacre | 295/37 |
| 2,697,015 | A | * | 12/1954 | Noe | 384/459 |
| 3,802,352 | A | | 4/1974 | Keller | |
| 4,529,241 | A | | 7/1985 | Jungbert | |
| 4,729,455 | A | * | 3/1988 | May | 188/58 |
| 5,884,956 | A | | 3/1999 | Pasquin | |
| 6,048,015 | A | | 4/2000 | Blasingame et al. | |
| 6,631,936 | B2 | | 10/2003 | Brinkmann et al. | |
| 2010/0320789 | A1 | * | 12/2010 | Karlson | 295/39 |

* cited by examiner

Prior Art

RAILWAY CAR INDEPENDENT AXLES WITH AXLE LOCKING MECHANISM

CROSS REFERENCE TO RELATED APPLICATION

This application is a continuation-in-part of U.S. patent application Ser. No. 12/457,724 filed Jun. 19, 2009 now abandoned entitled Railway Car Independent Axles.

FIELD OF THE INVENTION

This invention relates to the field of railway car axles that, in conjunction with wheels mounted on the axles, bear the weight of railway cars riding on rails, and in particular relates to railway car axles which are formed of at least one independent section having its inner end journalled in a casing or sleeve so as to permit free rotation of one axle section relative to the other axle section when the railway car is travelling around curves in the rails.

BACKGROUND OF THE INVENTION

The prior art is replete with attempts to allow independent rotation of oppositely disposed railway car wheels which are oppositely disposed on the opposite ends of an axle. For example in one early illustration, applicant is aware of U.S. Pat. No. 12,572, which issued Mar. 20, 1855 to Prentiss for a Car Axle. More particularly however applicant is aware of prior art having the specific object of providing a segmented axle extending between oppositely disposed railway car wheels for the purpose of permitting free rotation of one axle section relative to the other axle section when travelling around curves as for example stated in U.S. Pat. No. 977,002 which issued Nov. 29, 1910 to Girt et al for an Independent Car Axle, or so as to allow the wheels to operate independently of each other to thereby reduce the friction when the car is going around a curve and so that the outer wheel can revolve faster than the inner one, as taught in U.S. Pat. No. 205,324 which issued Jun. 25, 1878 to Whittic for a Car-Axel, or so as to reduce friction and consequent wear of car wheels and track when passing around a curve as taught in U.S. Pat. No. 302,120 which issued Jul. 15, 1884 to Fleming for a Car Axel, or, so as to provide car axles which permit their two wheels to turn independently of each other by the insertion of two separate short axles into opposite ends of a long sleeve or tube which connects the short axles and holds them in line as taught in U.S. Pat. No. 134,247 which issued Dec. 24, 1872 to Braymer et al for Car-Axles.

Applicant is also aware of a paper by John A. Elkins dated September, 1988, entitled Independently Rotating Wheels: A Simple Modification to Improve the Performance of the Conventional Three-Piece Truck; $9^{th}$ International Wheelset Congress.

What is neither taught nor suggested in the prior art and which is an object of the present invention to provide is a simple load and bending moment resistant arrangement of independent axle sections, in one embodiment lockable, which advantageously may be retrofit into existing one-piece axles, for use on the style of railway cars where the load is applied on the transversely outward side of the wheels so as to apply an upward bending moment urging the centre of the axle upwardly, and in particular for use on railway truck wheel and axle sets as disclosed by way of example in U.S. Pat. No. 3,802,352 which issued to The Timken Company on Apr. 9, 1974 for the invention of Keller. A copy of FIG. 1 from the Keller patent forms the prior art FIG. 1 of the present specification.

By way of illustration of the problem that is addressed by the present invention, in applicant's experience, conventional car axle housings, bushings and bearings are designed to carry in the order of 230,000 lbs between four axles under a car and that these loads are distributed to the wheels by loads applied to conventional bearings mounted on the laterally outermost ends of car axles where the axles protrude from the corresponding pair of oppositely disposed wheels. Thus loads in the order of approximately 30,000 lbs bear down on each of the outermost ends of the conventional unitary axles thereby exerting a bending moment on both ends of the axles which urges the axles to bow upwardly into a curve. In a conventional axle the loads are substantially resisted by the use of steel axles having a significant cross-sectional diameter, in the order of approximately seven and eight inches in applicant's experience. It is thus advantageous to replicate the load and bending moment bearing capabilities of a conventional solid axle in a segmented axle which provides for independent rotation of the opposite wheels on each axle and which also advantageously may be retrofitted to existing conventional solid axles.

SUMMARY OF THE INVENTION

In summary, the railway car axle according to one aspect of the present invention may be characterized as including a first stub axle mounted in a rigid hollow sleeve. The first stub axle has opposite inner and outer ends, and the sleeve has a first open end and an oppositely disposed first terminal end. A first bore is defined by a cylindrical wall extending from the first open end to the first terminal end. The first stub axle is journalled in the first bore so as to position the inner end of the first stub axle adjacent the first terminal end and so that the outer end of the first stub axle extends from the first open end.

Separate first inner and first outer housings for bushings or bearings also referred to collectively herein as bearings, and corresponding first bearings, are mounted tight to the inner ends of the first stub axle or to the housing and the first open end of the sleeve respectively so as to allow rotation of the first stub axle relative to the sleeve. Means are provided for retaining the first stub axle in the first bore.

The outer end of the first stub axle is, as conventionally done, adapted for mounting of a railway car wheel thereon and is further, as conventionally done, adapted for bearing a downward load associated with the railway car on load bearings mounted on an outermost end of the outer end of the first stub axle. The load bearings are thus displaced laterally outwardly of the railway car wheel when mounted on the outer end of the first stub axle.

The cylindrical wall of the sleeve has a wall thickness. The wall thickness is sufficient to provide stiffness substantially equivalent to a stiffness afforded by a solid shaft of a length substantially equivalent to a corresponding length of the sleeve when the solid shaft has a diameter substantially equivalent to a diameter of the first stub axle.

The first stub axle has a first length which may be at least substantially one-half of the length of the sleeve. Alternatively the first length may be substantially equivalent to the length of the sleeve.

In a further embodiment, a second bore may be formed in the sleeve oppositely disposed to and co-linearly with the first bore on opposite sides of a common terminal end wall disposed therebetween. The second bore extends from a second open end to a second terminal end, and wherein the first and second terminal ends are oppositely disposed faces on the opposite sides of the common terminal end wall. A second stub axle having opposite inner and outer ends is mounted in the second bore so as to position the inner end of the second stub axle adjacent the second terminal end and so that outer end of the second stub axle extends from the second open end. Again, separate second inner and second outer bearing housings, and corresponding second bearings, are mounted tight to the inner end of the second stub axle or housing and the second open end of the sleeve respectively so as to allow rotation of the second stub axle relative to the sleeve. Means are provided for retaining the second stub axle in the second bore.

Again, the outer end of the second stub axle is adapted for mounting of a railway car wheel thereon and is further, as conventionally done, adapted for bearing a downward load associated with the railway car on load bearings which are mounted on an outermost end of the outer end of the second stub axle so as to be displaced laterally outwardly of the railway car wheel when mounted on the outer end of the second stub axle.

Advantageously, the diameter of the first stub axle is substantially equal to the diameter of the second stub axle. Further, the first or second terminal ends may be shaped so as to cup their corresponding inner ends of their stub axles. For example, the inner end of the first stub axle may be truncated by a substantially planar face which is orthogonal to said bore. A thrust bearing may be mounted in the terminal end adjacent the planar face. Shims may be mounted adjacent the thrust bearing. Nylon may be inserted or injected to provide low friction surfaces.

The means for retaining the first stub axle in the first bore and the means for retaining the second stub axle in the second bore may include annular grooves in the first and second stub axles and correspondingly positioned apertures in the sleeve for receiving therethrough rigid elongate members into registry with the grooves when the first and second stub axles are mounted in the first and second bores respectively. For example, the apertures may be bolt holes and the members may be bolts.

The present invention in applicant's experience reduces wear on wheels and rails and reduces the power required to pull rail cars, and reduces drag by about 25 percent in corners when measured a 1/18 scale model weighted down with 250 pounds.

DETAILED DESCRIPTION OF EMBODIMENTS OF THE INVENTION

Figure 1:
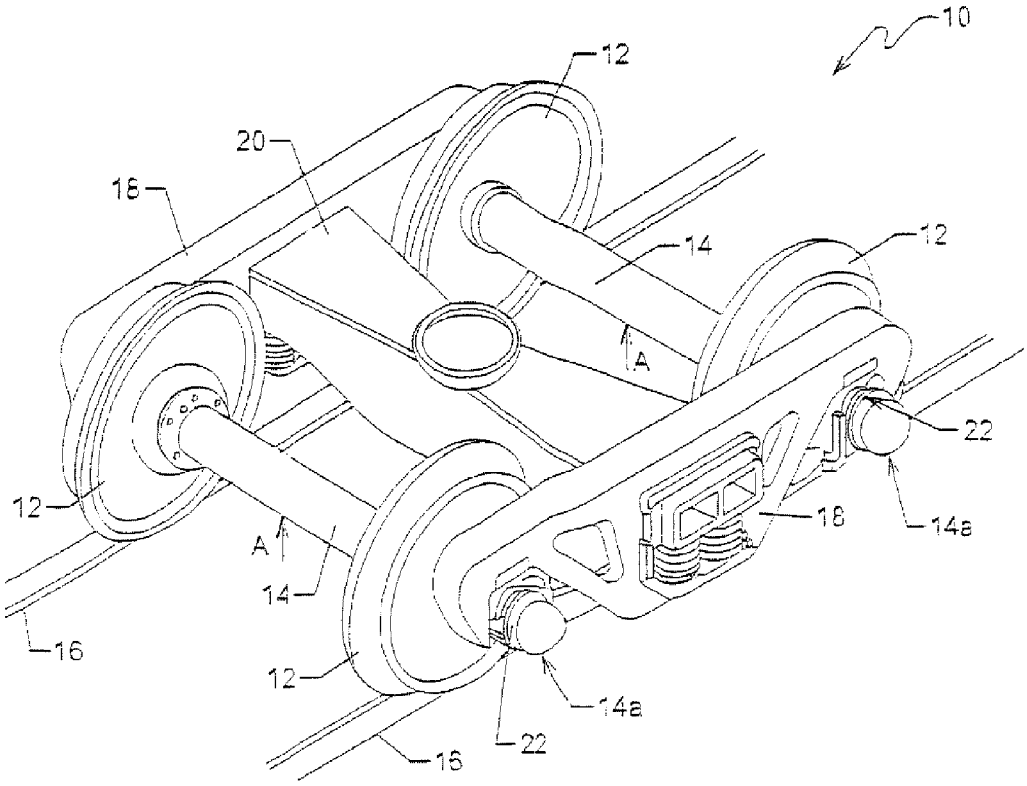
FIG. 1 is, in perspective view, a prior art railway car truck.

As seen in the accompanying figures wherein similar characters of reference denote corresponding parts in each view, FIG. 1 illustrates a prior art railway car truck 10 wherein wheels 12 are rigidly mounted onto the opposite ends of shafts 14 for rolling on rails 16. Load bearing members 18 transfer the load from the railway car (not shown) via cross-member 20 so as to distribute the load down onto axles 14 and thence to wheels 12 by loads applied substantially equally to the opposite-most ends 14*a* of axles 14. In particular, load bearing members 18 transfer the load downwards onto axle 14 via existing conventional bearings within bearing housings 22 mounted on the ends 14*a* of axles 14.

As described above, when substantial loads are applied downwardly to the laterally outermost ends 14*a* of axles 14, the result is a bending moment urging axles 14 to bow upwardly in direction A. Where, to applicant's knowledge, loads in the order of 60,000 lbs per axle are applied downwardly on ends 14*a*, the resulting bending moments, even though the moment arm between ends 14*a* and the fulcrum created where wheels 12 contact rail 16 is relatively short, can still result in significant torque about an axis parallel to rails 16. This results in an upward force tending to bow axles 14 upwardly in direction A as the bending resistance of axles 14, in combination with the bending arm distributed along the axles, resists the bending moment applied to the axles by the downward load onto ends 14*a*. It is understood however that it is merely applicant's understanding that these may be typical loads experienced by truck 10 and, as would be known to one skilled in the art, may vary significantly.

Consequently, due to the possible high loading and high bending moments to be resisted by axles 14, in order to achieve the advantages of decreased wear etc. that result from the use of a segmented axle, it should not be at the expense of the stiffness of the axle that resists the bending moment applied to it or results significantly in increased maintenance due to increased wear and tear of a segmented axle due to the combination of loads applied to it.

Figure 2A:
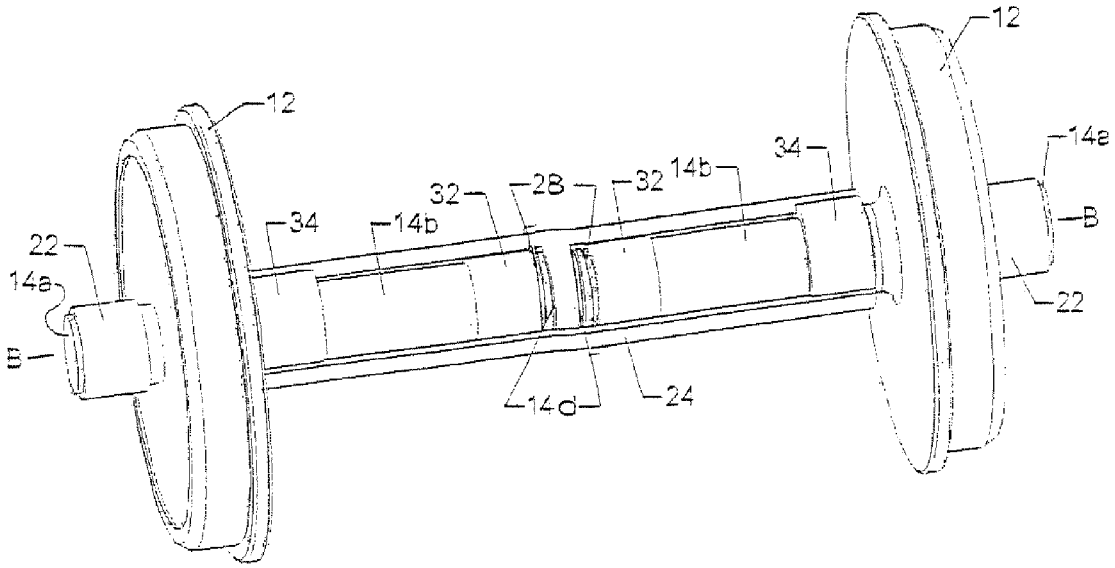
FIG. 2*a* is in partially cut-away perspective view, a railway car axle according to one embodiment of the present invention.

Thus in the present invention, in one preferred embodiment as seen in FIG. 2*a*, a conventional axle 14 may be cut in two, for example cut in half, to make two identical stub axles 14*b* each having opposed facing truncated or planar ends 14*c*.

Figure 2B:
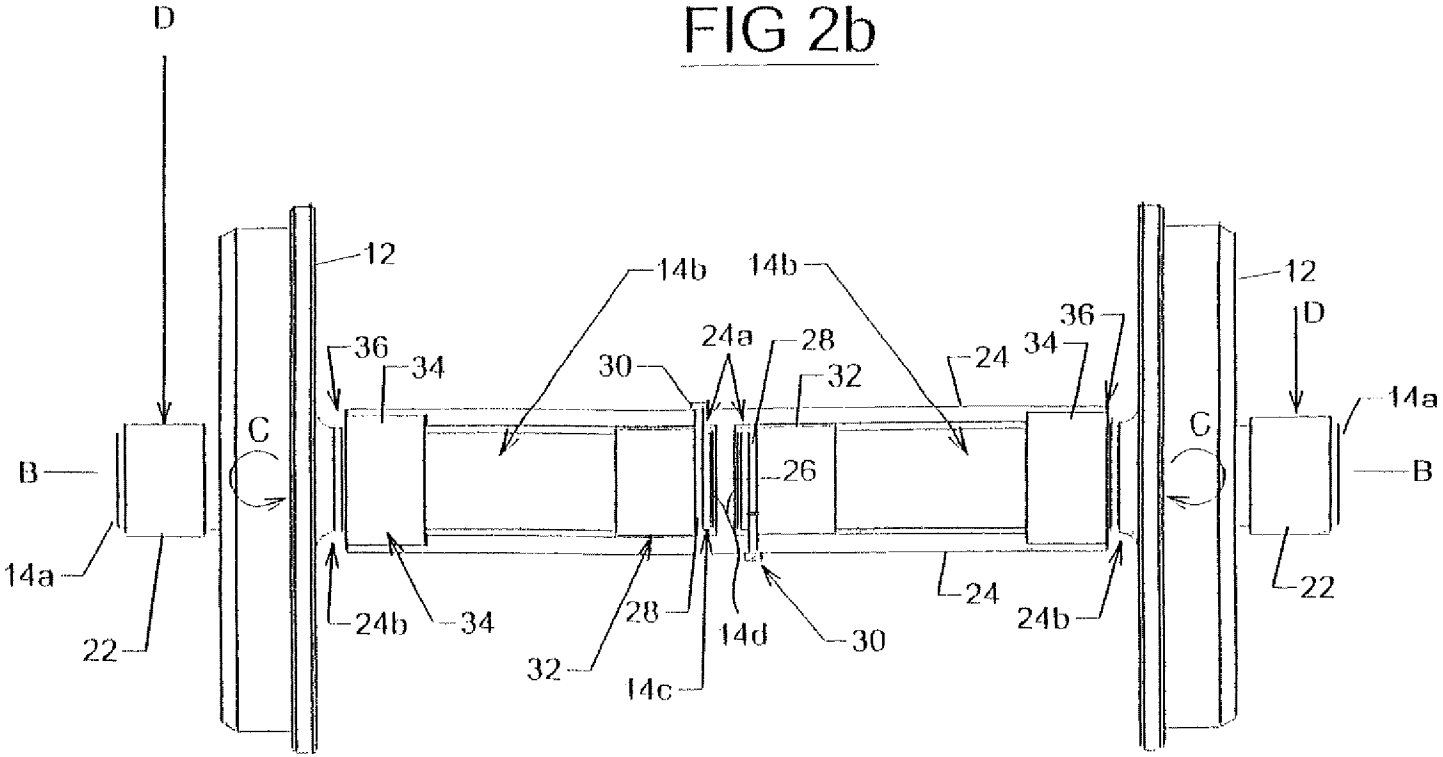
FIG. 2*b* is a front elevation view of the axle of FIG. 2*a*.

In one embodiment, stub axles 14*b* are journalled in corresponding cavities or bores in tubular outer sleeve such as axle housing 24. The axle housing is a solid pipe that is cored out to allow the axle to be inserted. It is not a prefabricated pipe that is used, as there is a solid thickness of material left in the cored out section to which the thrust washer abuts in each of the 3 versions of the axle described herein. As see in FIG. 2*b*, opposed facing planar ends 14*c* seat using thrust washers 14*d* into corresponding pockets 24*a* formed on opposite sides of common wall 26. Reference to washers is intended to collectively include washers or bearings herein. Wall 26 separates ends 14*c* from each other by a spacing equal to the thickness of the wall 26 along centroidal axis of symmetry B. Nylon may be inserted or injected to provide low friction surfaces in place of bearings or bushings.

Annular grooves 28 are formed around the opposed facing ends of stub axles 14*b* behind planar ends 14*c*. A bolt 30 may be mounted through a corresponding bolt hole in axle housing 24 that corresponds in position to the location of annular grooves 28 so that bolt 30 may be mounted through the bolt hole and across a tangent to annular groove 28 to thereby releasably secure the stub axles 14*b* within axle housing 24 with ends 14*c* snugged against thrust washers in corresponding pockets 24*a*.

A pair of inner axle bushings 32 are mounted behind annular grooves 28 on their corresponding stub axles 14*b* so as to be tight to the inner ends of stub axles 14*b* or to housing 24.

Axle housing 24 extends substantially the entire length of the combined stub axles between wheels 12, that is, extends substantially the entire width between wheels 12 which is substantially equal to the width between rails 16. A second pair of bushings 34 are mounted between axle housing 24 and stub shafts 24*b* at substantially the laterally outermost ends of axle housing 24. Thus as may be seen, the lateral spacing between inner axle bushings 32 and outer axle bushings 34 is maintained substantially at a maximum width apart in order to minimize the load carried by those bearings in resisting bending moments C acting on stub axles 14*b* and axle housing 24 so as to bow axle housing 24 upwardly in direction A as a result of downward loads applied to ends 14*a* in direction D by the downward loading of load bearing members 18 acting on bearings 22.

Bushings 32 and 34 may be conventional bushings such as manufactured and sold by The Timken Company of Canton, Ohio or other brass, or nylon bearings as would be known to one skilled in the art.

In one embodiment where existing axles 14 are cut in two to make two substantially identical stub axles 14*b*, these axle stubs may be machined approximately one or two inches shorter in length than the cut length to accommodate a one or two inch space between their ends. The stub axles are machined to seat a six inch bushing or bearing 32. The recess corresponding to annular groove 28 may be set back approximately three-quarters of an inch, that is, three-quarters of an inch between the end of bushing 32 and the planar end 14*c*, thereby leaving enough room for the slots in the axle or grooves.

Axle housing 24 may be approximately four feet in length and approximately for example four inches larger in diameter than the diameter of stub axles 14*b*. The bores formed within axle housing 24, within which to house stub axles 14*b*, are machined from each of the opposite ends of axle housing 24 so as to leave a wall thickness of approximately one inch for wall 26, and have a diameter approximately one-quarter inch larger than the diameter of stub axles 14*b*. Thus the machined bores will have a bore diameter of approximately six to seven inches and, as stated above, will have planar end pockets.

The laterally outermost ends 24*b* of the bores will be machined to a larger inside diameter, for example so as to have an inside diameter approximately one inch larger than the diameter of stub axles 14*b* and about six inches in length so as to hold outer axle bushing 34 tight to axle housing 24 and so as to provide for mounting a dust seal 36 between the laterally outermost ends of axle housing 24 and wheels 12. Advantageously, the axle housing 24, once it has been machined to create the bores as described above, will retain a sufficient wall thickness so as to remain as stiff, that is, resistant to bending as would be the original solid axle 24 prior to being cut in two. In this preferred embodiment then any additional stiffness contributed by the mounting as described above of stub axles 14*b* into the bores within axle housing 24 only lend to improve the stiffness resistance to bending moment C. The fact that the diameter of axle housing 24 is greater than the diameter of the original axle 14, assists in attaining the sufficient at least equivalent stiffness with a reasonable wall thickness to axle housing 24. Although in a preferred embodiment axle housing 24 exhibits equivalent stiffness to the original uncut axle 14, in one embodiment, the equivalent stiffness is attained in combination with the bored out axle housing 24 being snugly fitted with stub axles 14*b*, that is snugly mounted at their ends, between wheels 12 in bushings 32 and 34.

The difference in rotational velocity of each of wheels 12 on opposite ends of axle housing 24 is of relatively small magnitude given the curvature encountered in typical curves found in rails 16. Thus, the differential rotation between the independent axle sections in the present invention, in this embodiment between the opposed facing stub axles 14*b*, within axle housing 24 is relatively small, allowing then for relatively tight packing or at least lending to increased support by stub axles 14*b* contributing to the improved bending stiffness of axle housing 24.

Although not illustrated, it would be understood to one skilled in the art that grease or other lubricant fittings would be provided for lubricating the slip joints for example in pockets 24*a* and bushings 32 and 34, and bearings 22. Stub axles 14*b* may have opposed facing planar surfaces to accommodate the fitting of thrust bearings or washers and, for example, shims in order to maintain the desired wheel width.

Figure 2C:
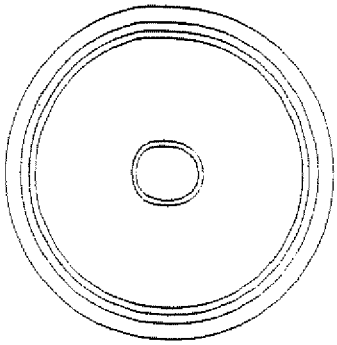
FIG. 2*c* is an end elevation view of the axle of FIG. 2*a*.
Figure 3:
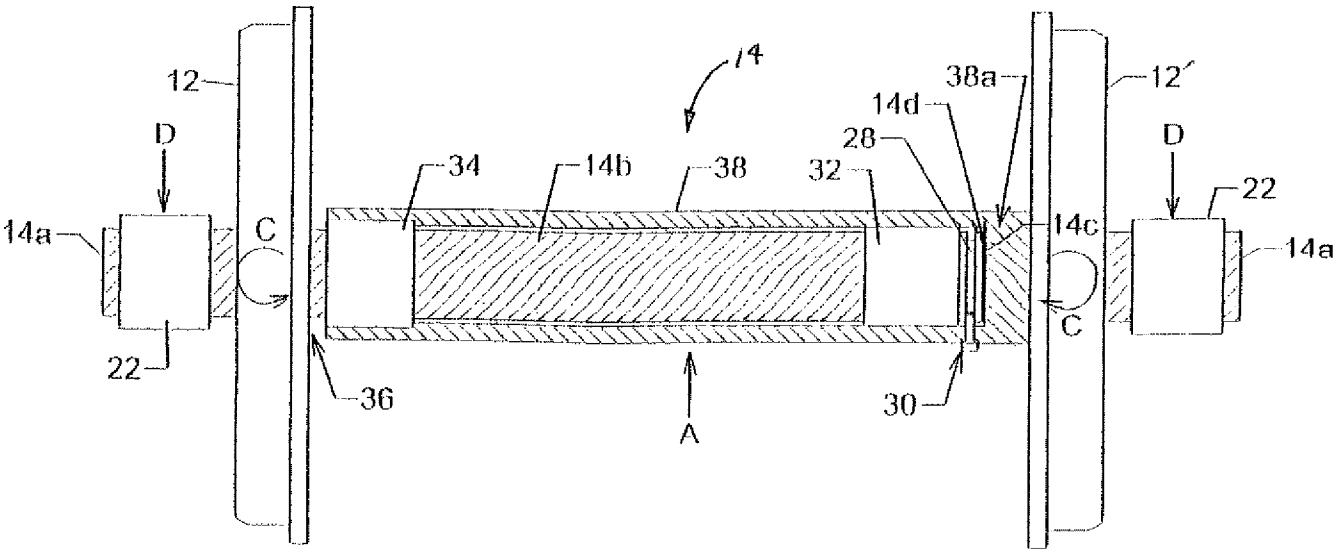
FIG. 3 is an alternative embodiment of the railway car axle of FIG. 2*a*.

In the alternative embodiment of FIG. 3, instead of shaft 14 being severed into two substantially identical half lengths, shaft 14 has one end 14*c* severed laterally inwardly and adjacent wheel 12'. Again, as in the embodiment of FIG. 2, the severed end of the stub shaft 14*b* may be a planar end 14*c* as illustrated to accommodate thrust bearings, washers, shims etc. Whatever the shape of end 14*c*, a correspondingly shaped pocket 38*a* is formed in axle housing 38 to seat end 14*c*. As before, an annular groove 28 is formed behind end 14*c* so that stub shaft 14*b* may be releasably secured snugly within a corresponding bore in axle housing 38 by the use of a bolt 30 mounted through a hole (not shown) in axle housing 38 so as engage within annular groove 28. Again, a bushing 32 is mounted behind annular groove 28 tight onto stub axle 14*b* or housing 38. At the opposite end of stub shaft 14*b*, laterally to the inside and adjacent wheel 12, bushing 34 is mounted within an increased diameter bore so as to be tight to the axle housing 38. Again, a dust seal 36 is mounted between bushing 34 and wheel 12.

Figure 4:
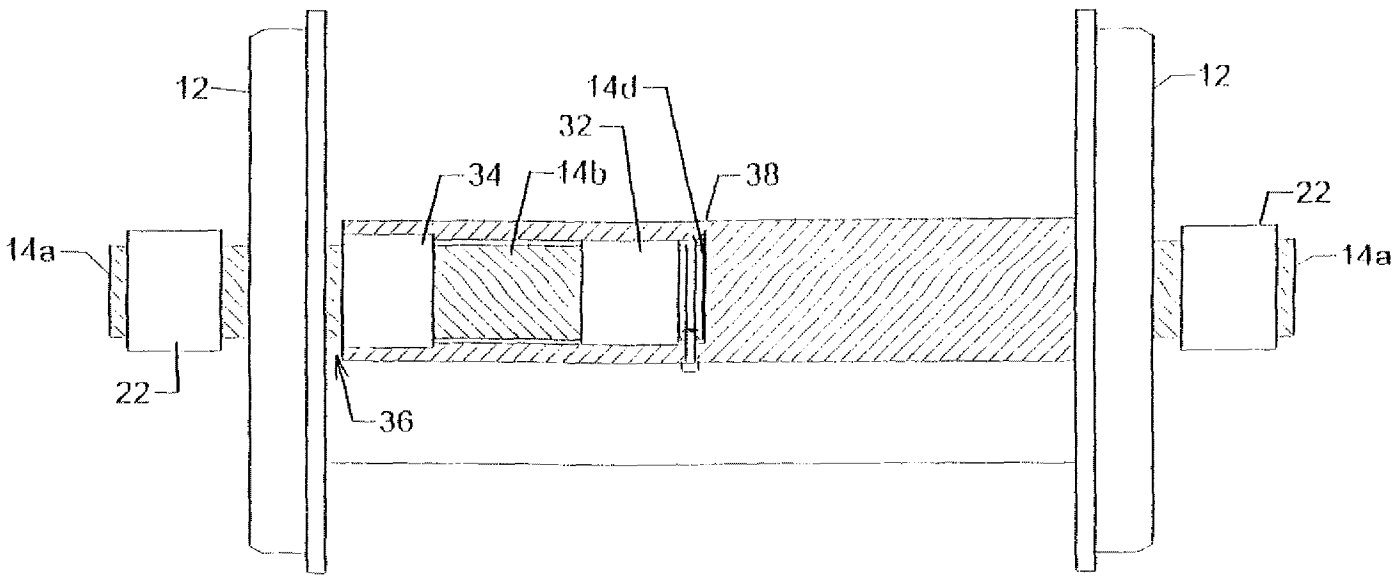
FIG. 4 is yet a further embodiment of the railway car axle of FIG. 2.
Figure 5:
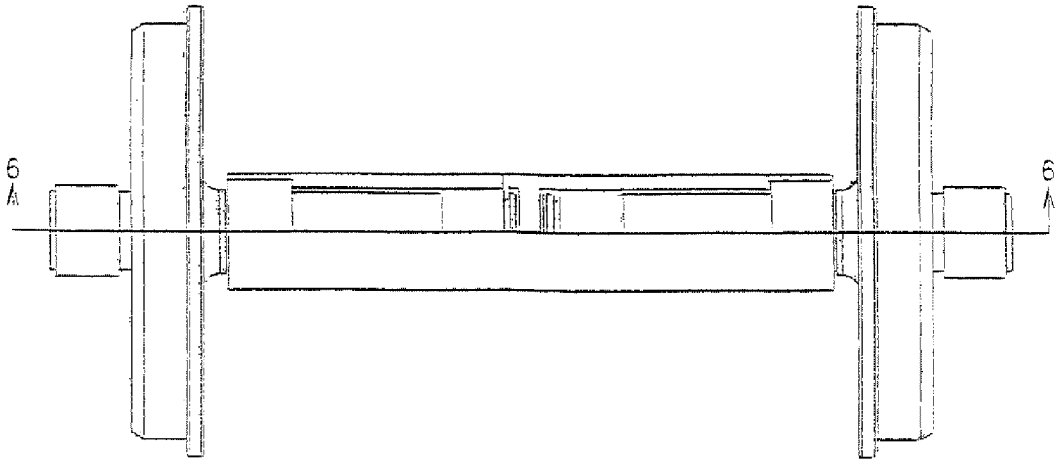
FIG. 5 is the front elevation of FIG. 2*a* showing the dimensions of one embodiment, which are not intended to be limiting.
Figure 6:
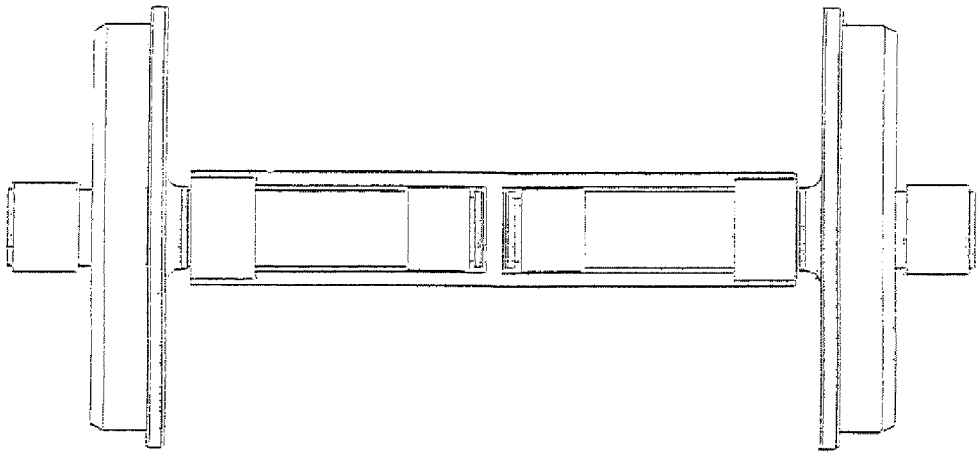
FIG. 6 is a sectional view along line 6-6 in FIG. 5.
Figure 7:
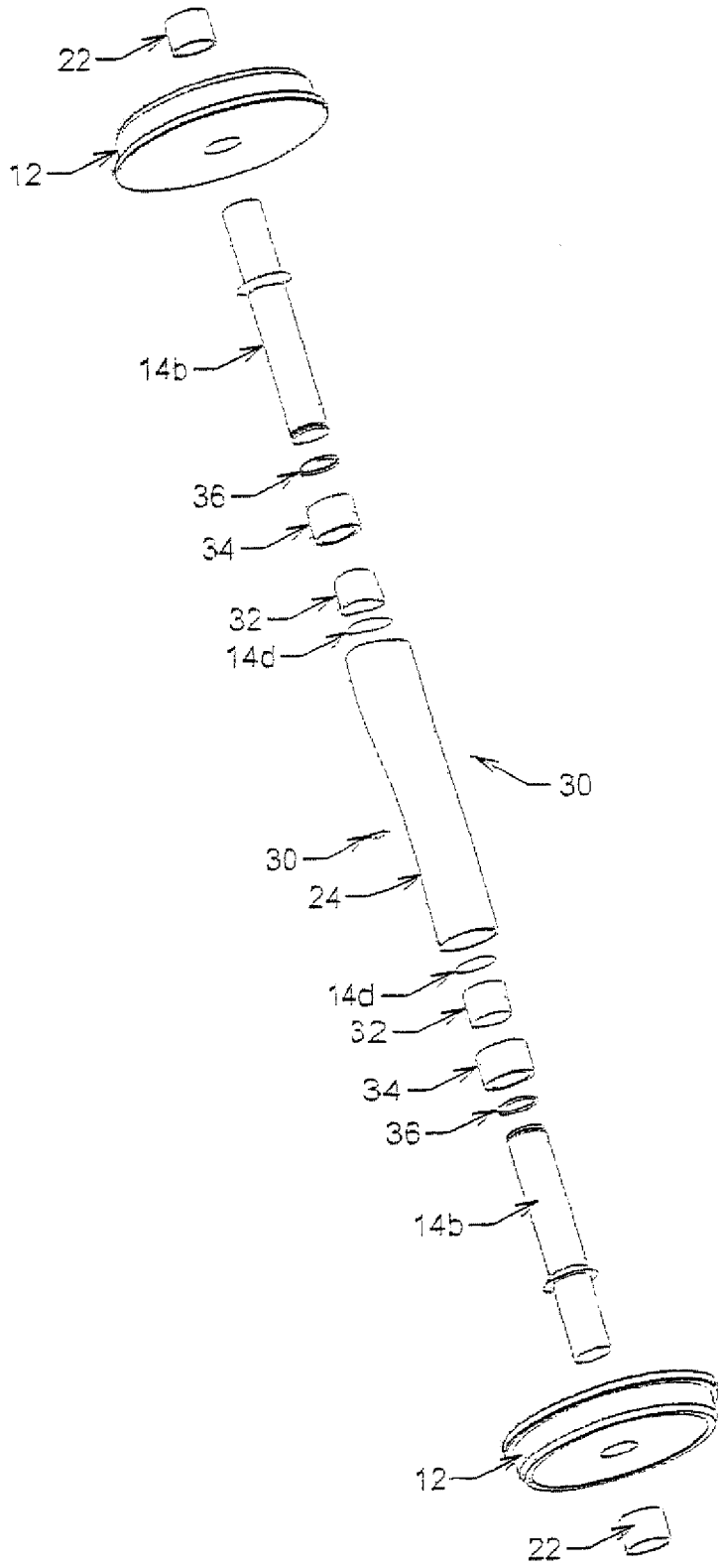
FIG. 7 is an exploded view of the axle of FIG. 2*a*.
Figure 8:
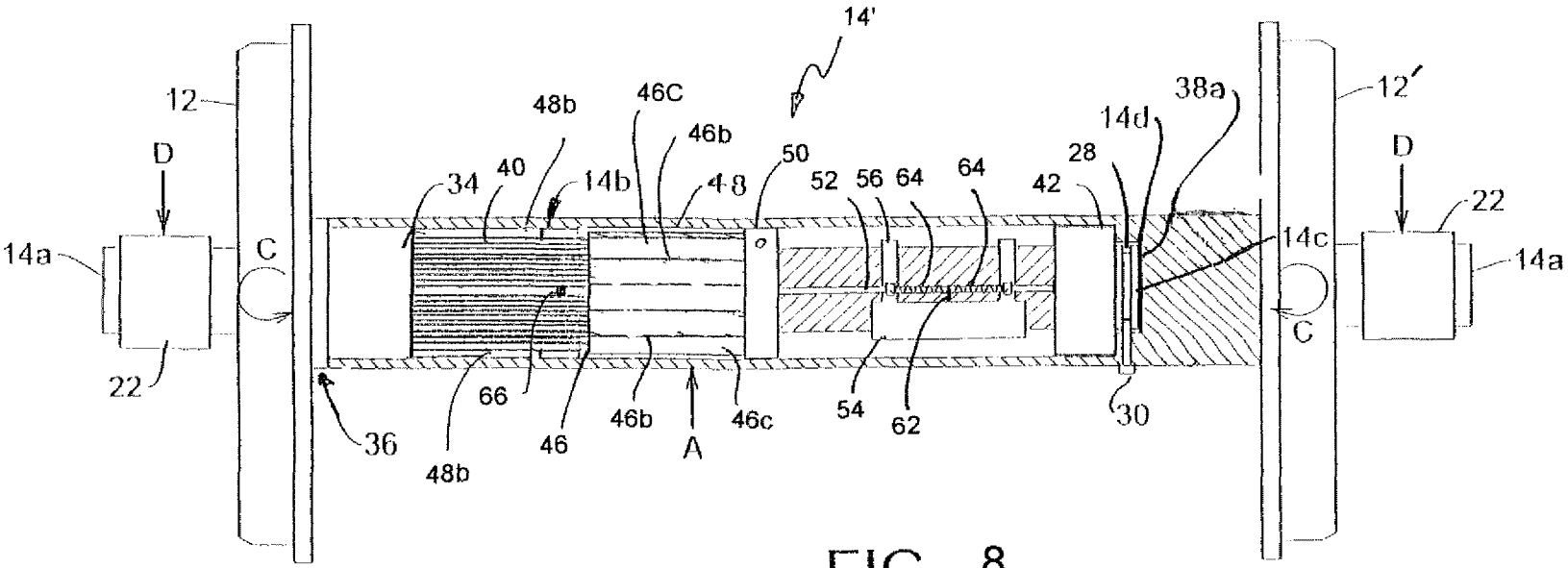
FIG. 8 is, in partially cut-away sectional view, an alternative embodiment so as to include an axle locking mechanism in the embodiment of FIG. 3.
Figure 9:
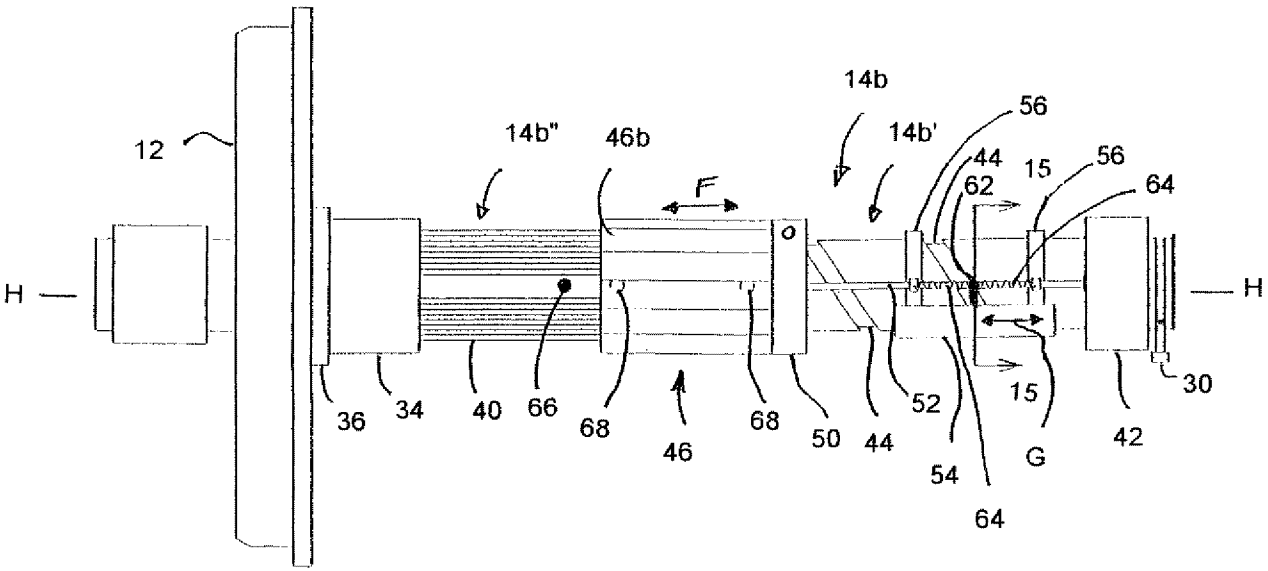
FIG. 9 is the stub axle and shuttle spur gear of the axle of FIG. 8.
Figure 10:
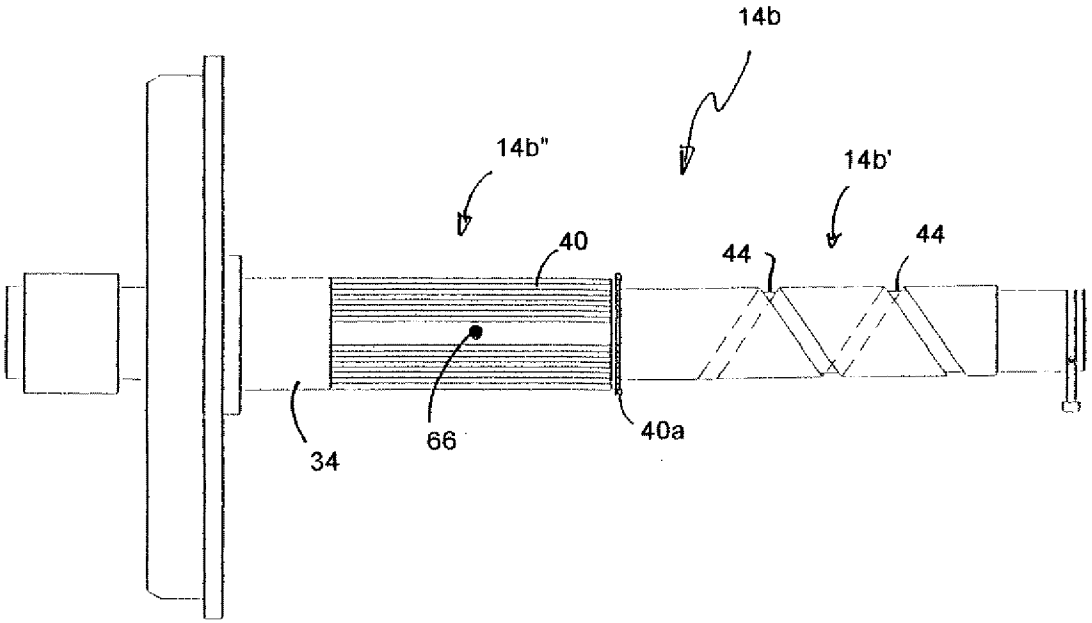
FIG. 10 is the stub axle of FIG. 9.
Figure 11:
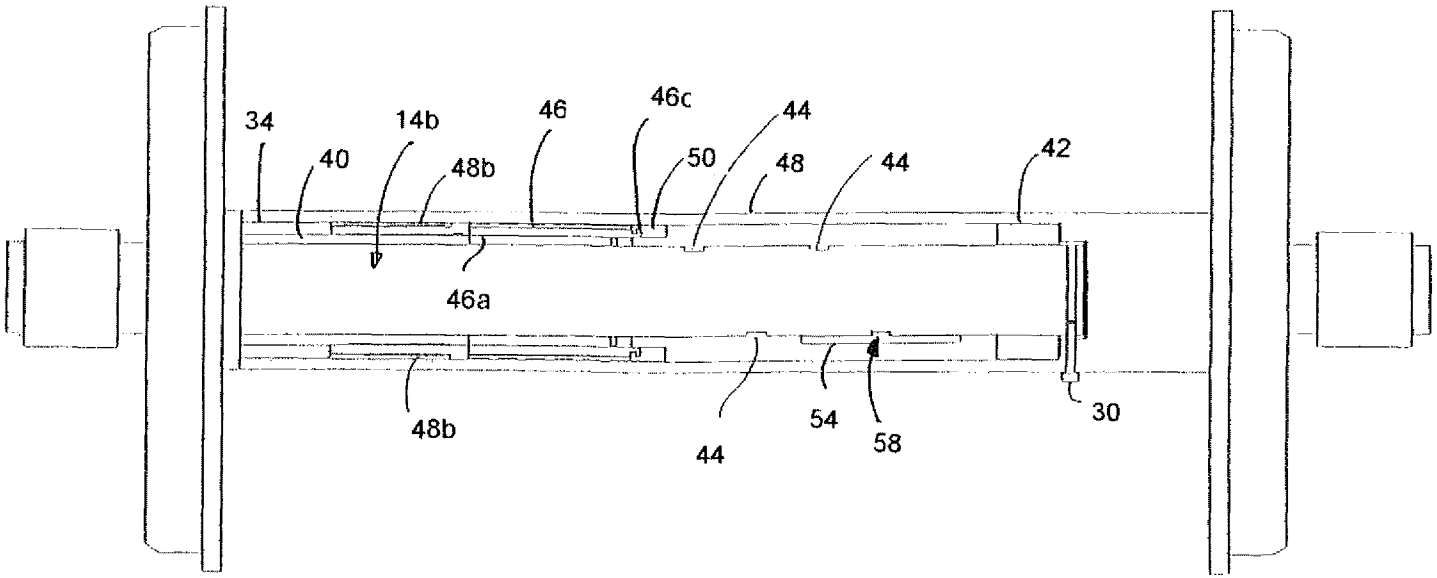
FIG. 11 is a partially cut-away sectional view through the view of FIG. 8.

As seen in FIG. 4, stub shaft 14*b* may be of a shorter length than in the embodiment of FIG. 3. Thus stub shaft 14*b* may for example be approximately one half or more of the length of the housing 38, and is approximately one-half the length in the embodiment of FIG. 4. As described above, the planar end

14*c* may be a flat end in order to provide for seating of a thrust bearing or washers, and shims as necessary to maintain spacing between the wheels.

In the further alternative embodiment of FIGS. 8-16 the embodiment of FIG. 3 has been varied to introduce an axle locking mechanism. In particular, stub axle 14*b* has splines 40 formed around the stub axle on the end 14*b*" of stub axle 14*b*, that is the end adjacent bushing 34. The opposite end 14*b*' of stub axle 14*b*, that is, the end adjacent bushing 42, is narrower than the diameter of splines 40 and has formed therein a helical track 44. A shuttle spur gear 46 has internal splines 46*a* which mate with splines 40 as gear 46 slides over splines 40 in direction F. Gear 46 has external spurs 46*b* formed around the outer cylindrical surface of gear 46. Spurs 46*b* are elongate and are parallel with both the long axis of stub axle 14*b* and with splines 40 and 46*a*.

Spurs 46*b* on shuttle spur gear 46 slidingly mate in corresponding linear, parallel elongate channels 48*a* formed in the end of axle housing 48 adjacent bushing 34. Channels 48*a* are formed as a rigidly spaced apart parallel array of linear channels, rigidly spaced apart around the longitudinal axis of cylindrical axle housing 48. That axis is co-linear with the longitudinal axis H of stub axle 14*b*. Raised lands 48*b* are formed on the interior surface of axle housing 48 between channels 48*a*. The constant mating of splines 46*a* on shuttle spur gear 46 to and along splines 40 on stub axle 14*b*, and the locking mating of spurs 46*b* on spur gear 46 into channels 48*a* when spur gear 46 is translated fully; towards bushing 34, locks stub axle 14*b* to axle housing 48. Gear 46 translates in direction F length-wise along, and sandwiched between, stub shaft 14*b* and axle housing 48.

Figure 12:
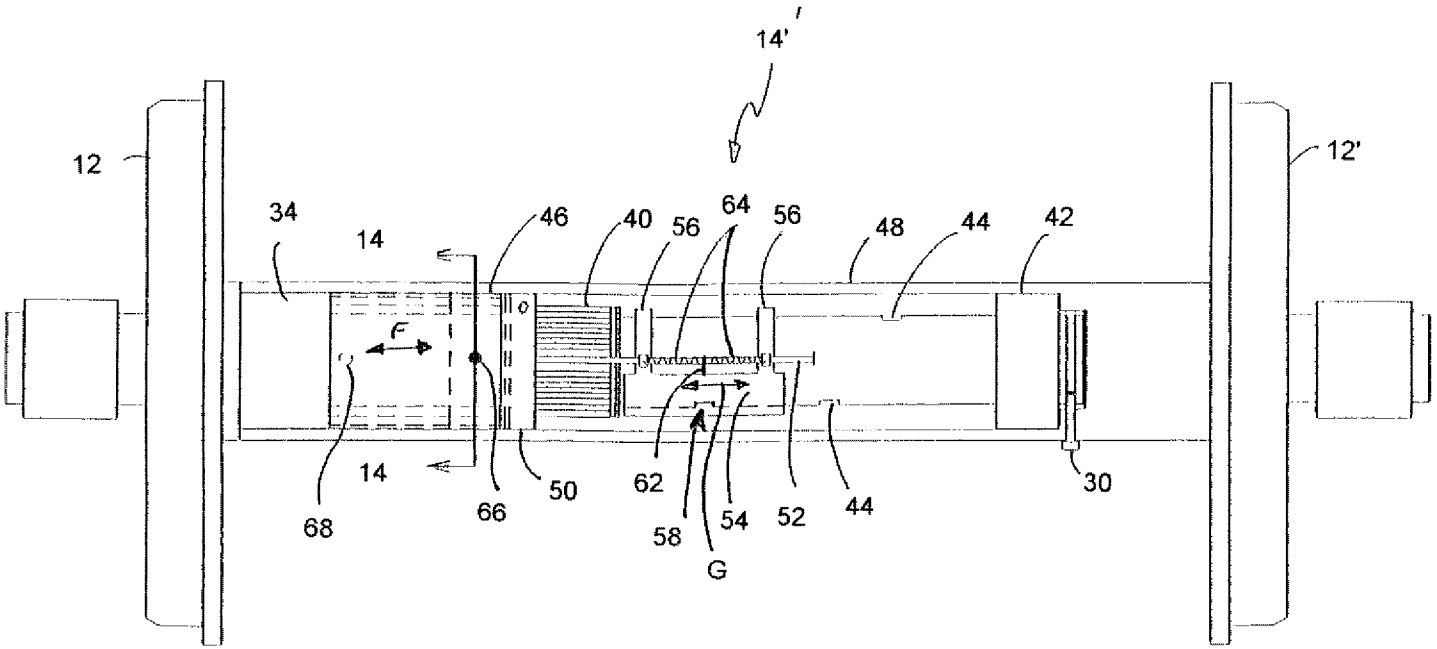
FIG. 12 is the view of FIG. 9 showing the shuttle spur gear fully slid onto the external splines of the stub axle.
Figure 13:
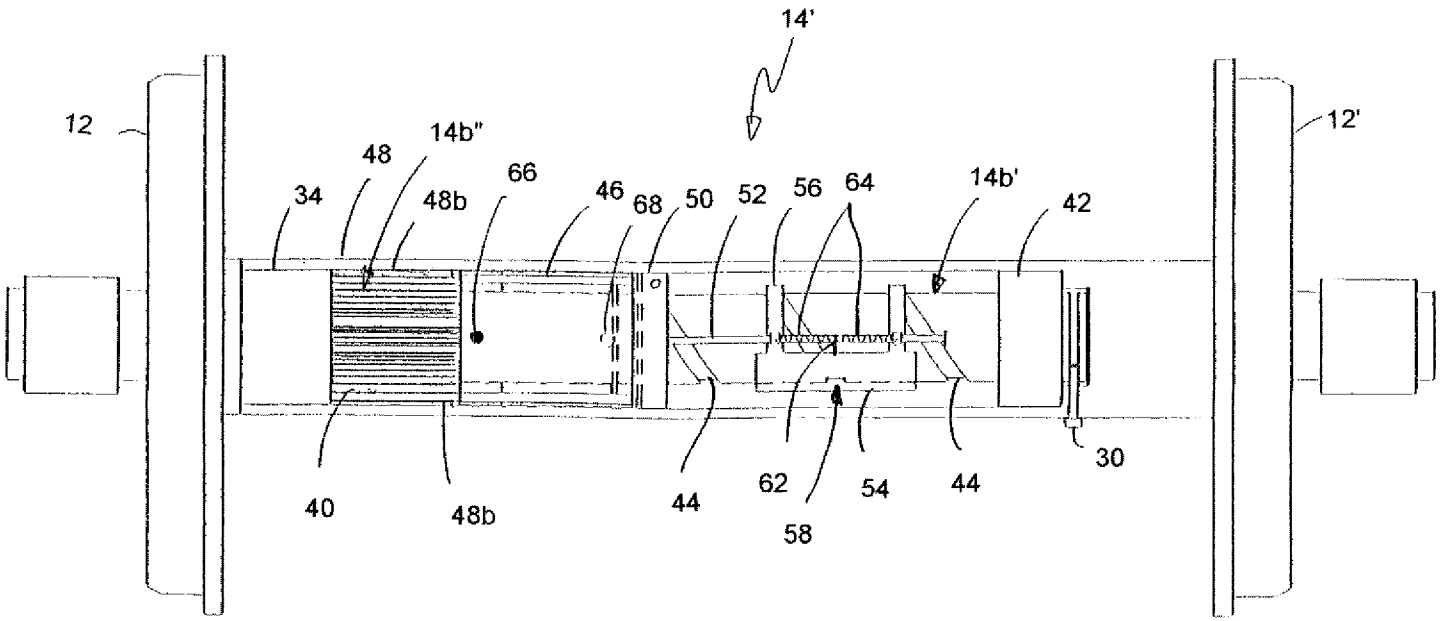
FIG. 13 is the view of FIG. 9 showing the shuttle spur gear slid partially onto the external splines of the stub axle so as to lock the spur gear onto one of the lockable positions on the external splines.
Figure 14:
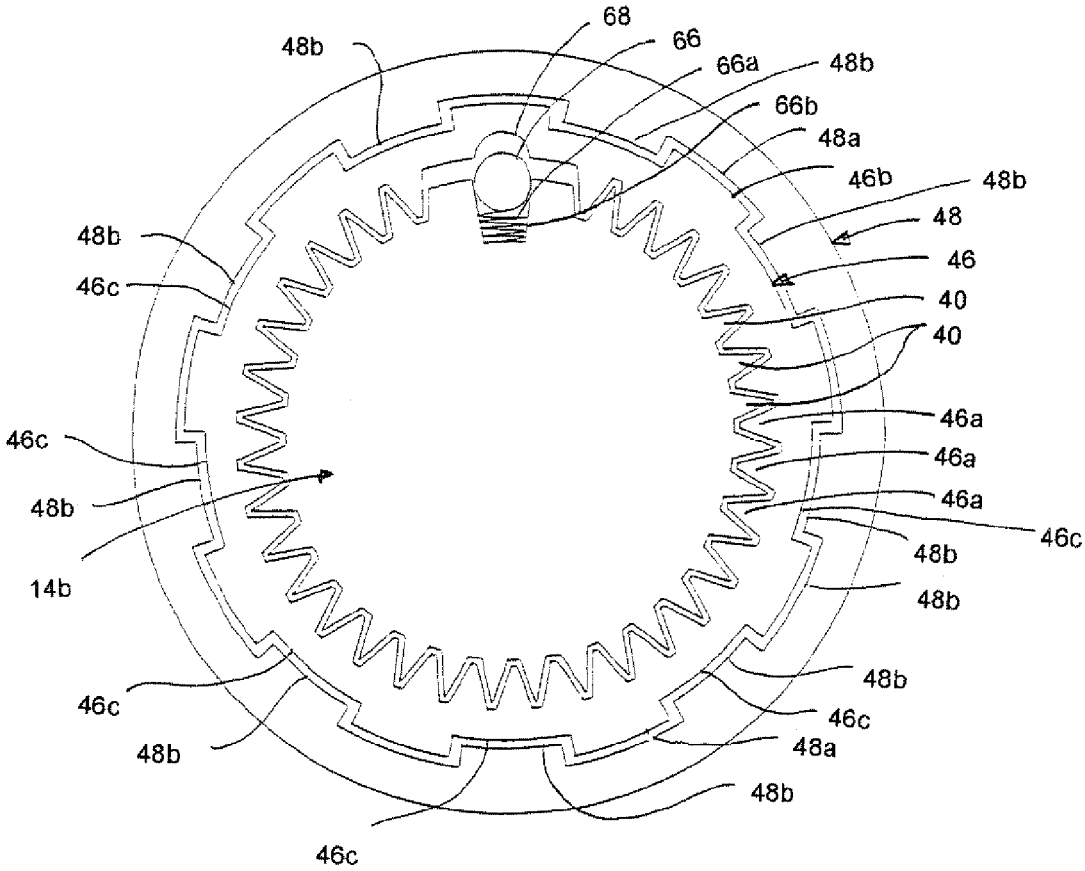
FIG. 14 is a sectional view along line 14-14 in FIG. 12.

The translation of shuttle spur gear 46 in direction F locks axle housing 48 relative to stub shaft 14*b* when shuttle spur gear 46 is slid all of the way to the end of end 14*b*" so as to mate channels 48*a* onto spurs 46*b*. Translation of shuttle spur gear 46 towards end 14*b*', that is, in a direction away from end 14*b*", disengages channels 48*a* from spurs 46*b* as splines 46*a* continue to be constrained to slide along splines 40. The locked position is shown in FIG. 12. The unlocked position is shown in FIG. 13. Thus in the unlocked position housing 48 is free to rotate about axis H independently of stub axle 14*b* and spur gear 46. In operation spur gear 46 is constrained in its translation in direction F by a snap ring 40*a* (seen in FIG. 10) engaging stops within spur gear 46. Locking ball 66, best seen in FIGS. 9, 10 and 14, mates in to a pair of detents 68 on gear 46. Detents 68 are spaced apart along direction F. The distance that gear 46 translates in direction F is the distance between detents 68. Gear 46 is shown translated further to the right in FIG. 9 than would ordinarily occur in order to show the position of ball 66 on splined end 14*b*". In reality, gear 46 is constrained by snap ring 40*a* from uncovering ball 66, otherwise ball 66 might fall out of its pocket 66*b*, that is, disengage from its position in stub axle 14*b*. Spur gear 46 may also disengage from splines 40 if allowed to translate too far.

A rotatable hub 50 is rotatably mounted onto the end of gear 46 closest to end 14*b*' and in particular is rotatably mounted onto annular flange 46*c* so that hub 50 is free to rotate about longitudinal axis H of stub shaft 14*b* so as to freely rotate around annular flange 46*c* relative to gear 46. A pair of rods 52 are disposed on opposite sides of end 14*b*' of stub shaft 14*b*. Rods 52 are mounted to hub 50 so as to be also spaced apart on opposite sides of hub 50. Rods 52 are parallel to each other and extend along opposite sides of end 14*b*' of stub shaft 14*b* for the purposes described below.

Figure 15:
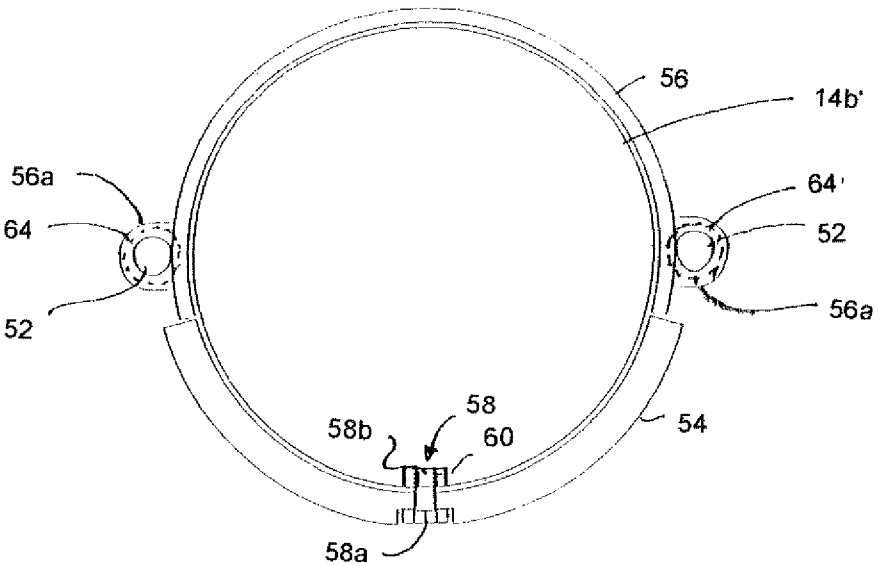
FIG. 15 is a sectional view along line 15-15 in FIG. 9.
Figure 16:
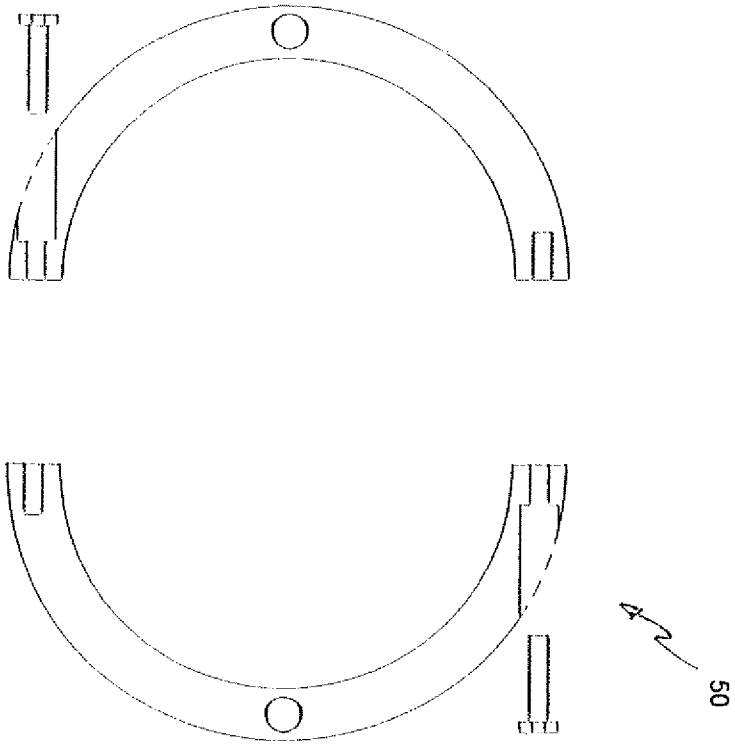
FIG. 16 is, in exploded elevation view, the rotatable hub as it would be viewed just prior to mounting onto the shuttle spur gear.

A suspended weight 54 is mounted onto end 14*b*' by means of a pair of wide semi-circular bands 56 best seen in FIG. 15. Bands 56 are formed so as to conform snugly over end 14*b*' and so as to slide thereover. Weight 54 is also formed so as to conform to the underside of end 14*b*' while suspended on bands 56. A track follower 58 is mounted through an aperture in the bottom of the suspended weight 54 so as to extend upwardly from the bottom of the inside surface of weight 54. In one embodiment, track follower 58 is a threaded member having a base end 58*a* mating into a corresponding depression in the outer surface of weight 54, and having a protruding end 58*b* protruding upwardly from the inner surface of weight 54 and mounted into an annular roller 60. Roller 60 is mounted into, so as to follow along, helical track 44. A counterweight (not shown) may be provided to balance the asymmetric weighting of weight 54 for balanced high speed rotation.

Rods 52 are mounted to bands 56, on opposite sides thereof. In particular, rods 52 are journalled through eyes 56*a* formed on opposite sides of bands 56. A rigid spring stop 62 is rigidly mounted to, so as to extend upwardly from, on either side of, weight 54. Stops 62 slidably engages each rod 52 on either side of bands 56. A pair of springs 64 are mounted on each of rods 52. Each pair of springs are mounted so as to be oppositely disposed on opposite sides of the corresponding spring stop 62. Thus, as weight 54 is translated in direction G by the action of track follower 58 following along helical track 44, spring stops 62 engage against one or the other of the oppositely disposed springs 64 so as to compress those corresponding springs. The spring compression urges rods 52, and thus gear 46 to translate correspondingly in direction F by the action of rods 52 acting on hub 50, itself mounted onto annular flange 46*c* of gear 46.

With spur gear 46 engaged onto splines 40, that is, so as to mate internal splines 46*a* onto splines 40, gear 46 locks into the locked position of FIG. 12 or the unlocked position of FIG. 13 by the engaging of locking ball 66 into one of the corresponding pair of locking detents 68 formed on the inside surface of gear 46. Locking ball 66 is urged outwardly so as to engage into detent 68 by spring 66*a* mounted in a pocket 66*b* in which ball 66 is nested.

Thus it will be appreciated that differential rotation between wheels 12 and 12' causing corresponding differential rotation about axis H between stub axle 14*b* and housing 48 causes shuttle spur gear 46 to translate in direction F thereby locking housing 48 onto stub axle 14*b* or unlocking housing 48 from its mating with stub axle 14*b*.

Figure 1A:
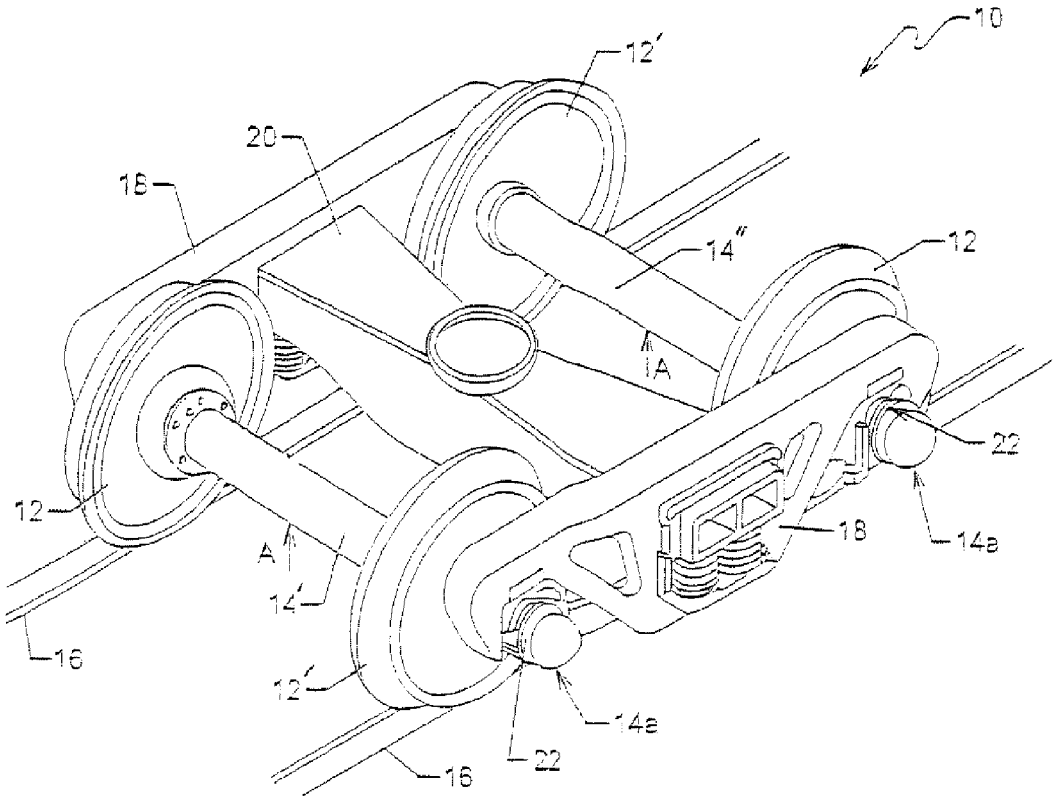
FIG. 1*a* is the view of FIG. 1 where the truck includes independent, lockable axles according to the embodiment of FIG. 8, with the forward axle in a first orientation and with the rear axle in a second position orientation whereby in a left or right turn one of the axles will be locking as the other is unlocking.

As seen in FIG. 1*a*, in turns where truck 10 is following on tracks 16 such that wheel 12' rotates faster than wheel 12 then housing 48 will also be rotating about axis H faster than stub axle 14*b* is rotating about axis H. This causes follower 58 to follow along track 44 at a speed governed by the differential rotation speed between housing 48 and axle 14*b* and by the inclination of track 44 relative to axis H. The inclination and the length of track 44 may be set to pre-set the amount of differential rotation required for locking and unlocking of the axles. In opposite turns where wheel 12 is rotating faster than wheel 12', then the follower would move along track 44 to engage spur gear 46 into its locking position at the far end of end 14*b*", thus locking the axle.

As seen in FIG. 1*a*, advantageously, in truck 10 axle 14" is reversed to axle 14'. Thus in a turn where for example axle 14' is unlocking, axle 14" would be simultaneously locking. That is, in the view of FIG. 1*a*, in axle 14' the locking position of spur gear 46 is to the left and track 44 is to the right, and in axle 14" the locking position of spur gear 46 is the right and track 44 is to the left.

During turns then, the torque caused by locking of the axle is transferred from one wheel to the opposite wheel by the mating of the wheel to the stub axle, the stub axle with the spur gear, the spur gear with the axle housing and the axle housing with the opposite wheel. The overlapping of the stub axle, spur gear and axle housing provides support to resist bending or deflection.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A railway car axle comprising:

a stub axle having opposite inner and outer ends, a rigid hollow sleeve having an open end and an oppositely disposed terminal end, and a bore defined by a cylindrical wall extending from said open end to said terminal end, and wherein said stub axle is journalled in said bore for rotation in said bore, and wherein said inner end of said stub axle is adjacent said terminal end and wherein said outer end of said stub axle extends from said open end, an axle locking mechanism, wherein said outer end of said stub axle has external splines therearound, and wherein said inner end of said stub axle is narrower in diameter than a diameter of said external splines and has a helical groove track formed therealong, and wherein said sleeve has a parallel radially spaced apart array of linear channels formed around said cylindrical wall, a hollow, cylindrical shuttle spur gear having internal splines formed therein for mating onto and along said external splines, and having external spurs for mating into and along said array of linear channels when said spur gear is mated so as to be sandwiched between said stub axle and said sleeve, said spur gear having a follower mounted thereto, said follower mated into, so as to follow along, said helical groove track during differential rotation of said stub axle relative to said sleeve, wherein, during said differential rotation, said differential rotation urges said follower along said helical groove track to shuttle said spur gear between a spline engaging position wherein said spur gear engages said external splines and locks said sleeve to said stub axle, and a spline disengaged position wherein said spur gear is disengaged from said external splines and unlocks said sleeve from said stub axle.

2. The axle of claim 1 wherein said stub axle has a length which is at least substantially one-half of a length of said sleeve.

3. The axle of claim 2 wherein said length of said stub axle is substantially equivalent to said length of said sleeve.

4. The axle of claim 1 further comprising a weight slidably mounted onto and adapted for sliding along said inner end of said stub axle, and further comprising a rotatable hub mounted on an inner end of said spur gear, said inner end of said spur gear corresponding to said inner end of said stub axle, and wherein said weight is mounted by a rigid frame to said hub and is asymmetrically distributed about said inner end of said stub axle to bias said frame into a constant orientation relative to the force of gravity acting on said weight, and wherein said follower is mounted to said weight.

5. The axle of claim 4 wherein said frame includes a parallel laterally spaced apart pair of rods disposed on opposite sides of said inner end of said stub axle, and wherein said weight is supported on said inner end of said stub axle by at least one collar, and wherein said pair of rods are mounted to said at least one collar.

6. The axle of claim 1 wherein said terminal end is shaped to conform to said inner end of said stub axle.

7. The axle of claim 6 wherein said inner end of said stub axle is a truncated planar face.

8. The axle of claim 6 wherein said inner end of said stub axle is truncated by a substantially planar face which is orthogonal to said bore.

9. The axle of claim 8 further comprising a thrust bearing mounted in said first terminal end adjacent said planar face.

* * * * *